United States Patent [19]

Kashima et al.

[11] 4,295,017

[45] Oct. 13, 1981

[54] LIMIT SWITCH

[75] Inventors: Isoo Kashima; Masami Mishina, both of Watarai; Yosio Takase, Matsuzaka; Katsumi Maruchi, Tsu, all of Japan

[73] Assignee: Matsushita Electric Works, Ltd., Osaka, Japan

[21] Appl. No.: 127,885

[22] Filed: Mar. 6, 1980

[30] Foreign Application Priority Data

Mar. 6, 1979 [JP] Japan ..... 54-28513[U]

[51] Int. Cl.[3] ..... H01H 3/16

[52] U.S. Cl. ..... 200/47; 200/153 T; 200/153 V; 200/330; 200/340

[58] Field of Search ..... 200/47, 153 T, 153 V, 200/330, 340

[56] References Cited

U.S. PATENT DOCUMENTS

| | | | |
|---|---|---|---|
| 2,236,680 | 4/1941 | Fry | 200/47 |
| 2,431,747 | 12/1947 | Fry | 200/153 T |
| 2,454,341 | 11/1948 | Repka | 200/153 T |
| 3,390,242 | 6/1968 | Koepko | 200/153 V |
| 3,427,420 | 2/1969 | Geremia et al. | 200/330 |

FOREIGN PATENT DOCUMENTS

| | | | |
|---|---|---|---|
| 639036 | 10/1977 | U.S.S.R. | 200/47 |

*Primary Examiner*—John W. Shepperd

*Attorney, Agent, or Firm*—Burns, Doane, Swecker & Mathis

[57] ABSTRACT

A limit switch wherein a first spring means for actuating a push-button of selfcontained micro-switch and a second spring means only which engages an operating means for absorbing an over-travelling stroke of the operating means which receives an external operating force are both disposed inside a limit switch housing. In normal non-actuating position, respective biasing forces of the both spring means are balanced so that the second spring means restrains the first spring means from engaging the push-button but, upon application of the operating force through the operating means to the second spring means, the restraint of the first spring means is released due to a resilient bowing of the second spring means so as to have the push-button actuated by the biasing force of the first spring means, and the second spring means continues to further bow for absorbing the over-travelling.

20 Claims, 11 Drawing Figures

LIMIT SWITCH

This invention relates generally to limit switches and, more particularly, to improvements in switches which are actuated to switch on or off by an external force of a movable member of an associated device to detect a limit position of the member and include means for absorbing such force sequentially applied after the actuation of the switch.

An exemplary structure of conventional switches of the kind referred to is as shown in FIG. 1, in which generally a micro-switch 1 having a push-button 2 operatively coupled to a switch mechanism in the micro-switch and extended out of it as resiliently biased is housed in a housing 3 of the switch, a generally cylindrical extension 4 is provided on the outer wall of the housing, an operating member 5 is slidably disposed in an aperture made in an extended end of the extension 4, a plunger 6 having a pair of axially separated flanges 7 and 7' and carrying an inner coil spring 8 held between the flanges 7 and 7' is disposed between the member 5 and the push-button 2 made accessible through an aperture of the housing 3 defined by a wall part 10 of the housing, with an inner end of the plunger 6 on the side of the flange 7' fixed to the plunger being butted against the push-button and with the other flange 7 slidable but restricted in its axial movement by a stopper at the other outer end of the plunger being engaged with an inner edge of an inside end of the member 5, and an outer coil spring 9 is held between an outer edge of the said end of the member and the wall part 10 of the housing, as disposed around the respective flanges 7 and 7' of the plunger 6, so that the spring 9 will normally bias the operating member 5 to its outermost non-actuating position at which the inner spring 8 is expanded to incur no actuating force through the plunger to the push-button 2. When an external operating force indicated by an arrow F is applied to the operating member 5 to compress the outer spring 9, the member 5 depresses the slidable flange 7 of the plunger 6 and compresses the inner spring 8 against the fixed flange 7' and, as the biasing force of the spring 8 thus compressed exceeds the resilient biasing force of the push-button 2, the plunger 6 urges the push-button 2 to actuate the micro-switch 1. When the force F is still applied sequentially after the actuation of the micro-switch, the fixed flange 7' of the plunger is caused to collide with the wall part 10, whereby a further movement of the plunger is restricted but the sequential force F depressing the slidable flange 7 is absorbed by the spring 8 which is further compressed by the sequential force. In this arrangement, however, there have been such defects that the two coil springs 8 and 9 for absorbing the sequentially applied operating force after the actuation of the switch mechanism which causes an over-travelling of the operating member 5 (which shall be referred to as "OT" hereinafter) and for resetting the operating member 5 to its original non-actuating position, respectively, have to be employed in their sufficiently expanded state for providing a space of preactuation-travelling of the operating member (which shall be referred to as "PT" hereinafter), resulting in that the dimensions of the limit switch specifically in the direction of operating the same becomes large to render the usage of the switch in respect of available space in connection with the moving member of the associated device to be restrictive, that the OT absorbing spring is disposed within the space for PT of the resetting spring to cause such absorbing action sequentially after the switch actuation in the same stroke of the operating member, so that a space or stroke for the OT absorption is restricted to be small to also render the usage to be restrictive for avoiding any risk of damages due to a large OT that cannot be absorbed, that the opening force for the switch is required to be relatively large and cannot be made smaller in order to resist against both and respective biasing forces of the resetting spring and OT absorbing spring while the limit switches are generally desired to be responsible to smaller operating forces, and that a certain number of parts such as the slidable and stationary flanges on the plunger are required to prevent the OT absorbing spring from being actuated during the PT stroke and to cause the spring to be actuated sequentially after the switch actuation, so that the number of required parts for the switch operation and OT absorption will become large to cause assembling work to be complicated and manufacturing costs to be high. The present invention has been suggested in view of defects involved in the conventional limit switches of the kind referred to.

A primary object of the present invention is, therefore, to provide a limit switch having the least possible dimensions specifically in the direction of operating the switch.

Another object of the present invention is to provide a limit switch which allows the required space for the OT absorption to be remarkably larger without causing the dimensions of the switch to become larger.

Still another object of the present invention is to provide a limit switch which can be actuated with a smaller operating force to be reliably responsive thereto, while providing a sufficient and effective function of the OT absorption.

A further object of the present invention is to provide a limit switch which can be manufactured in a simpler manner and economically.

Other objects and advantages of the present invention shall be made clear upon reading the following disclosure of the invention detailed with reference to preferred embodiments shown in accompanying drawings, in which.

Figure 1:
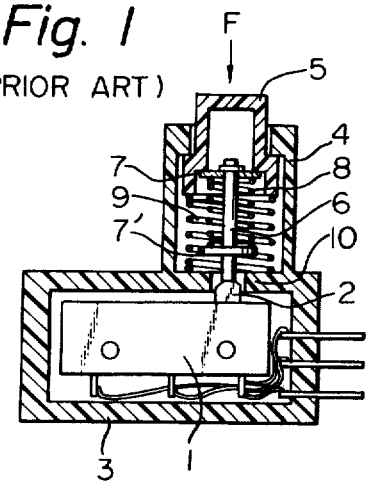
Fig. 1 (PRIOR ART)
FIG. 1 is a sectioned view of a conventional limit switch for schematically showing an exemplary one of conventional structures for the switch operation and OT absorption.

While the present invention shall now be explained mostly with reference to the embodiments shown in the drawings, the intention is not to limit the invention to the particular embodiments but is to rather include all modifications, alterations and equivalent arrangements possible within the scope of appended claims.

Referring now to the most preferable embodiment of the limit switch according to the present invention with reference to FIGS. 2 through 5, generally, a micro-switch 11 having a push-button 2 extended at one end out of the body of the micro-switch and operatively coupled at the other end to a switch mechanism contained in the body is housed in a housing 13 of the limit switch and conveniently made of a synthetic resin molding, an operating means 14 is operatively secured to the housing 13 for transmitting an external force of a movable member of an associated device (not shown) or the like to an interior space 15 of the housing receiving therein the micro-switch 11 and communicated with the exterior, and a resilient means 16 in an elongated and cantilevered form is disposed within the interior space 15 of the housing as fixed thereto at one end and extended at the other end to resiliently engage an interior end of the operating means 14 for receiving the transmitted external force and causing the push-button 12 to be operated upon the force reception, as will be detailed later. A socket means 17 having plug members connected to terminals of the micro-switch 11 is secured to a wall of the housing 13, and a connector means 18 is to be coupled to the socket means 17 for connecting its plugs to an electric circuit of the associated device (not shown).

Figure 3:
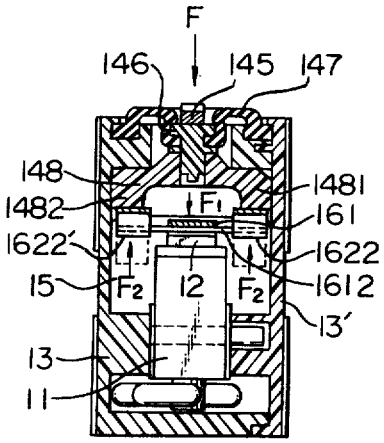
FIG. 3 is a cross sectional view of the limit switch taken along line III—III in FIG. 2 with the covering plate mounted.

In the present instance, the operating means 14 comprises a cantilevered arm 141 having at a free end a wheel 142 for slidably engaging the movable member at its limit position of the associated device and pivotably journaled at the other end to the housing 13 by means of a pivot pin 143, as biased by means of a coil spring 144 fitted between the arm and the housing to the outermost position of the wheel 142, a branch arm 145 of the arm 141 bent from an intermediate portion thereof to reach an entrance of an aperture 151 of the housing 13 communicating the interior space 15 with the exterior of the housing, and an operating member which comprises a first rigid member 146 movably held at the entrance of the aperture 151 to engage a tip end of the branch arm 145 by means of a resilient diaphragm 147 made of rubber or the like and secured at the outer periphery to the housing so as to close the entrance, and a second rigid member 148 having two folked ends 1481 and 1482 and detachably coupled at the center to the first rigid member 146 while disposing the respective folked ends 1481 and 1482 on respective lateral sides of the micro-switch 11 with respect its longitudinal direction, as will be seen best in FIG. 3.

Figure 4:
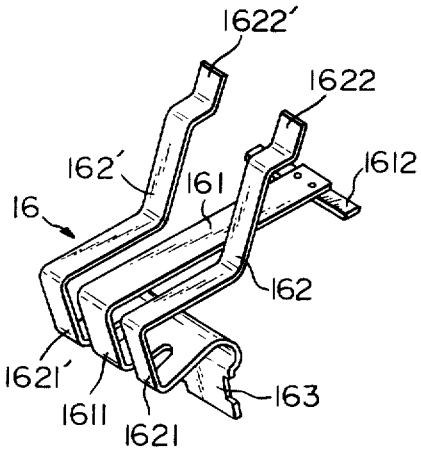
FIG. 4 is a perspective view of an integral spring member employed in the embodiment of FIG. 2 for achieving both functions of operating the push-button of self-contained micro-switch and absorbing the OT of switch operating member, which is shown in a state before being set up to be ready to be assembled with other elements.
Figure 5:
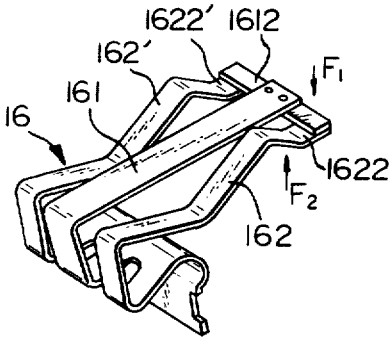
FIG. 5 is a perspective view of the spring member of FIG. 4 in a ready state as set up to be assembled.
Figure 2:
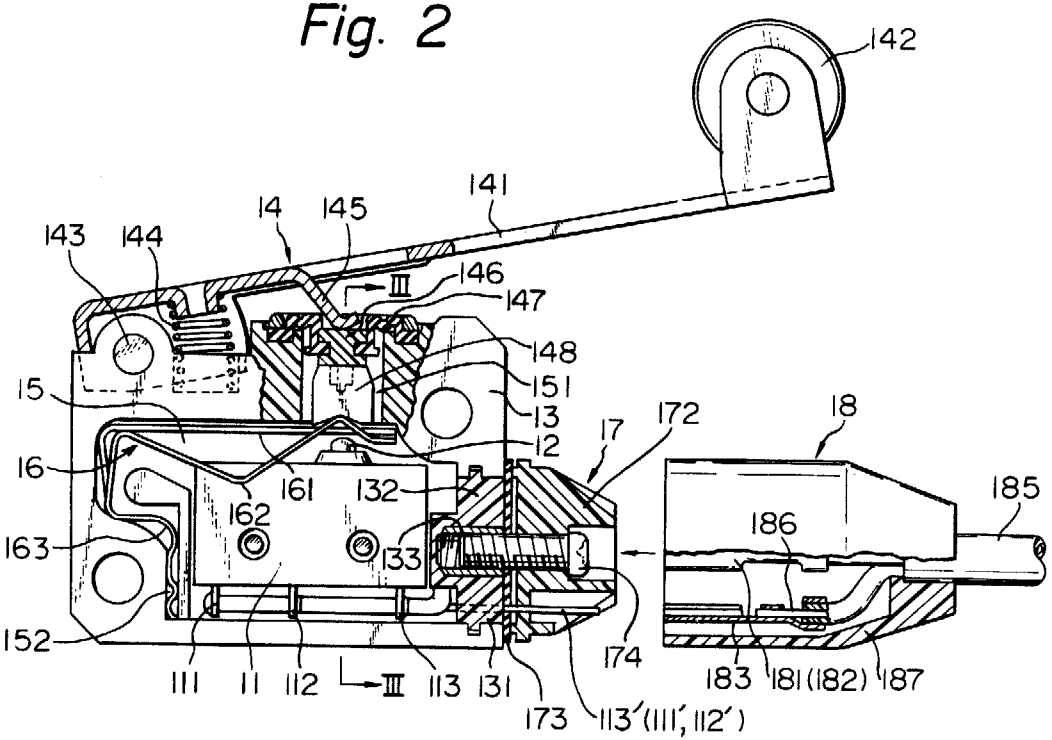
FIG. 2 is a side elevation in a magnified scale of a preferred embodiment of the present invention together with a socket and connector means employed in association with the limit switch in the present invention, with certain portions shown in section and with a covering plate of switch housing removed.

The resilient means 16 is formed in such a structure as shown in FIGS. 4 and 5, in which a central spring leaf 161 and two lateral side spring leaves 162 and 162' are joined integral at one end through bent portions 1611 and 1621, 1621', respectively, to a base 163 at which the spring means 16 is fixed as inserted into a slit 152 provided in the interior space 15, so that the entire spring means 16 will be substantially in an L-shape as seen from a lateral side as in FIG. 2. The other free end of the central leaf 161 is provided with lateral extensions 1612, by calking a separate leaf preferably of a rigid material to the free end in the present instance, so as to be in T-shape, and the respective side leaves 162 and 162' are bent at an intermediate position so as to have their free ends 1622 and 1622' extended in a direction opposite to the base 163 with respect to the central leaf 161, as shown in FIG. 4. In order to assemble the spring means 16 in position within the interior space 15 of the housing with the operating means 14, the respective free ends 1622 and 1622' of the side leaves are urged to bow toward the side of the base 163 and are resiliently engaged to the respective lateral extensions 1612 of the central leaf 161, as seen best in FIG. 5. In this state of the respective central and side spring leaves engaged with one another, the central leaf 161 is caused to yield a biasing force $F_1$ acting in the direction toward the base 163 by the engaged ends 1622 and 1622' of the respective side leaves 162 and 162' which imposing an opposite directional biasing force $F_2$ to the lateral extensions 1612 of the central leaf, but threse two forces $F_1$ and $F_2$ are balanced with each other in the engaged state of the respective leaves. The spring means 16 in this state is assembled in the position as described above together with the micro-switch 11 positioned between the intermediate bent portions of the side leaves 162 and 162', as seen in FIG. 2, so that the central leaf 161 will be interposed at its portion adjacent the free end between the respective folked ends 1481 and 1482 of the operating member 14 and the push-button 12 of the micro-switch 11 while the respective side leaves 162 and 162' will engage at their portions adjacent their ends 1622 and 1622' with the folked ends 1481 and 1482 of the operating means 14 so as not to break the balanced relationship between the two forces $F_1$ and $F_2$.

In the thus assembled state of the limit switch as shown in FIGS. 2 and 3, the operating means 14, spring means 16 and push-button 12 are held in their normal non-actuating position, in which the branch arm 145 simply abuts the rigid member 146 so that the diaphragm 147 holds the member 146 in its normal outermost position and the side leaves 162 and 162' of the spring means 16 also hold the folked rigid member 148 in its normal untermost position. When the movable member of the associated device comes into engagement with the wheel 142 to bow the cantilevered arm 141 of the operating means against the resetting force of the spring 144 with the operating force F, the branch arm 145 urges the rigid members 146 and 148 to move toward the push-button 12 against a resilient force of the diaphragm 147, whereby the respective side spring leaves 162 and 162' of the spring means 16 are also urged by the respective folked ends 1481 and 1482 of the member 148 to resiliently bow in the direction of the force F. This bowing of the side leaves 162 and 162' causes the balanced state of the spring means 16 to break, so that the biasing force $F_1$ of the central spring leaf 161 will be freed to act, whereby the central leaf 161 is caused to resiliently engage the push-button 12 to depress the same so as to actuate the switch mechanism of the micro-switch, due to that the respective ends 1622 and 1622' of the side spring leaves 162 and 162' are moved in disengaging direction with the extensions 1612 of the central leaf 161.

In the event that the operating force F continues to thus urge the respective rigid members 146 and 148 even after the actuation of the switch mechanism, the side spring leaves 162 and 162' are further bowed to their position as shown by broken lines in FIG. 3, disengaging from the lateral extensions 1612 of the central leaf 161 which keeps the push-button depressed with its own biasing force $F_1$, so as to absorbe such sequential operating force F with their biasing force $F_2$ which increases as their bowing advances.

When the operating force F is releases, the resilient diaphragm 147 which has been expanded to allow the rigid members 146 and 148 to move into their innermost position is caused to return with its own resiliency to the original position together with the members 146 and 148, the returning movement of which is supported by the biasing force $F_2$ of the side leaves 162 and 162' of the spring means 16, and the side leaves 162 and 162' also return to their engaging position with the extensions 1612 of the central leaf 161. As this engaging position is reached, the central leaf 161 is caused to separate from the push-button 12 by means of the biasing force $F_2$ of the side leaves 162 and 162', whereby the push-button 12 returns to the original position to terminate the actuation of the micro-switch and the central leaf 161 and side leaves 162 and 162' of the spring means 16 finally return to their original engaging and balanced state of the non-actuating position.

The actuation of the micro-switch causes the switching on or off or a switching over of a movable contact actuated by the depression of the push-button with respect to a stationary contact or a pair of normally opened and normally closed stationary contacts. In the illustrated case of FIG. 2, the micro-switch 11 has three externally extended terminals 111, 112 and 113, the former two of which, for example, are connected to the pair of stationary contacts and the latter of which is connected to the movable contact. In order to supply an electric current to these contacts, the housing 13 of the limit switch employed in the present invention is provided with the socket means 17 fitted to an aperture 131 made in a wall of the housing, and the means 17 comprises a base 132 of an insulative material and complementarily fitted in the aperture 131, three conductive plugs 111', 112' and 113' respectively connected at one end to each of the terminals 111, 112 and 113 of the micro-switch and carried by the base 132 as passed therethrough to extend the other ends externally, and an insulative fitting member 172 which is secured through a sealing 173 of a rubber plate or the like to the base 132 as well as to the outer surface of the housing by means of a screw 174 which is screwed into a threaded sleeve 133 embedded in the base 132, allowing the externally extended ends of the plugs to be accessible. In the present instance, these plugs are arranged to form a U-shape in their mutual relationship of passing through the base 132. The connector means 18 comprises three fitting terminals 181, 182 and 183 respectively connected to conductor wire ends 186 of a triple wire cord 185 and a covering 187 preferably made of an insulative and resilient material for covering the fitting terminals 181–183. The covering 187 is opened on the side of extended ends of the fitting terminals while secured on the other side to the cord, and the connector means 18 is fitted to the fitting 172 of the socket means 17, so that the respective fitting terminals will be fitted and connected to each of the plugs 111'–113' and the opened side of the covering 187 will be fitted around the periphery of the fitting 172 so as to achieve a water-tight sealing.

Figure 6:
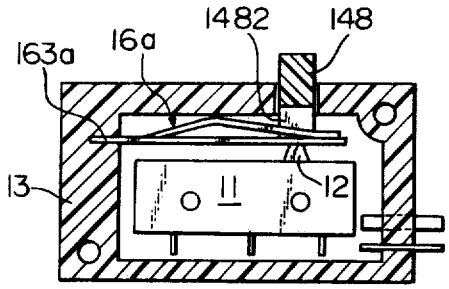
FIG. 6 is a schematic section view showing another embodiment of the present invention.
Figure 7:
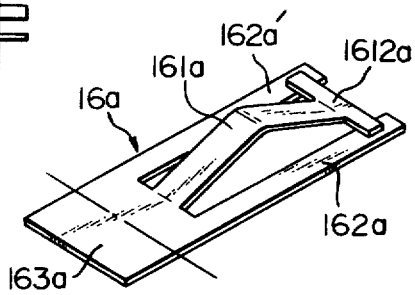
FIG. 7 is a perspective view of a spring member used in the embodiment of FIG. 6.

Referring to another embodiment shown in FIGS. 6 and 7, an integral straight plate-shaped spring means **16*a* is employed instead of the substantially L-shaped spring means 16 in the case of the first embodiment of FIGS. 2 to 5, and other elements and their arrangement may be the same as those of the first embodiment. This spring means 16*a* comprises also a central spring leaf 161*a* having at one end lateral extensions 1612*a* so as to be in T-shape, and a pair of lateral side spring leaves 162*a* and 162*a'* extending parallel to the central leaf 161*a*, and the respective spring leaves 161*a*, 162*a* and 162*a'* are formed by cuting a single plate material into the shape so that they are made integral on the side of a base 163*a*, in common to the case of the first embodiment of FIGS. 2–5. In contrast to the spring means 16 of the first embodiment where the lateral side leaves have to be made longer than the central leaf since the side leaves are bent, the central leaf 161*a* in the present instance is made longer than the side leaves 162*a* and 162*a'* and preliminarily bent at an intermediate portion so that the lateral extensions 1612*a* at said one end will be once separated away from a plane defined between free ends of the side leaves 162*a* and 162*a'*. Then, the free ends of the side leaves 162*a* and 162*a'* are urged to bow beyond the lateral extensions 1612*a* and are, thereafter, engaged to the extensions so as to achieve a state of FIG. 7**, in which the same balanced relationship in the biasing forces $F_1$ and $F_2$ as in the case of the first embodiment is achieved.

The thus arranged spring means **16*a* is assembled in the interior space of the housing 13 of the limit switch as fixed at the base 163*a* to a wall of the housing, so that the lateral side leaves 162*a* and 162*a'* will engage the respective folked ends 1481 and 1482 of the rigid member 148 of the operating means 14 while the central leaf 161*a* will oppose the push-button 12 of the micro-switch 11**.

The operation mode of this second embodiment is identical to that in the case of the first embodiment and shall not be detailed here. Since the spring means **16*a*** in the second embodiment is substantially of a straight type, however, the interior space of the housing for receiving the micro-switch and spring means can be minimized in size and made simpler in shape. As the lateral side spring leaves in the present embodiment are relatively shorter than those in the first embodiment because of the straight shape of the means, the allowance for the OT absorption becomes somewhat smaller, but the present embodiment should find its utility when applied to an associated device where an available space for mounting the limit switch is rather small and a stroke of the OT is relatively small.

Figure 8:
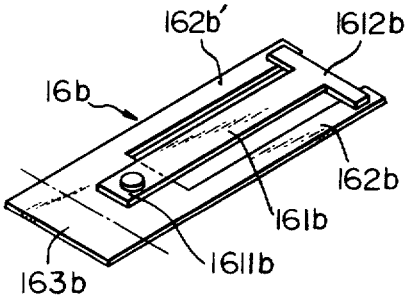
FIG. 8 is a perspective view of another spring member shown as a further embodiment of the present invention in the same assembling manner of the spring member as in the embodiment of FIG. 6.

Instead of preparing the central and lateral side spring leaves from a single plate to be integral from the first as in the case of the first or second embodiment, it is possible to prepare the central leaf separately from the lateral side leaves as shown in FIG. 8, where a central leaf **161*b* separately prepared in T-shape to have lateral extensions 1612*b* at one end and preliminarily provided with a curvature is joined at the other end 1611***b* by means of riveting or the like to an integral base 163*b* of a pair of lateral side leaves 162*b* and 162*b'* to engage the lateral extensions 1612*b* of the central leaf with free ends of the lateral side leaves so that the before described relationship of the respective biasing forces $F_1$ and $F_2$ and their functions will be achieved.

Figure 9:
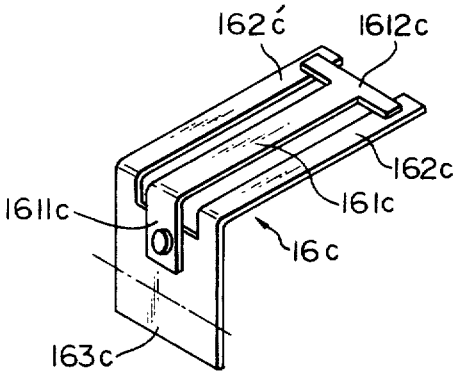
FIG. 9 is a perspective view of still another spring member shown as still further embodiment of the present invention to be used in the same assembling manner as in that of FIG. 2.

The arrangement of the spring means as above of FIG. 8 is also applicable to the substantially L-shaped spring means as used in the first embodiment. In this case, as shown in FIG. 9, a central spring leaf 161*c* prepared separately in T-shape to have lateral extensions 1612*c* at one end and bent at the other end 1611*c* to have a certain acute angle is joined at the bent end 1611*c* to an integral base 163*c* of a pair of lateral side spring leaves 162*c* and 162*c'* also bent adjacent the integral base 163*c* preferably to have an obtuse angle or at least at right angles, so that the lateral extensions 1612*c* of the central leaf will engage respective free ends of the side leaves 162*c* and 162*c'* so as to achieve the same relationship and functions of the respective biasing forces $F_1$ and $F_2$ as in the foregoings.

Figure 10:
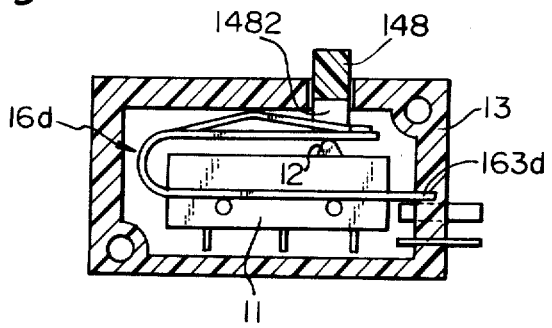
FIG. 10 is a schematic section view showing a further embodiment of the present invention.
Figure 11:
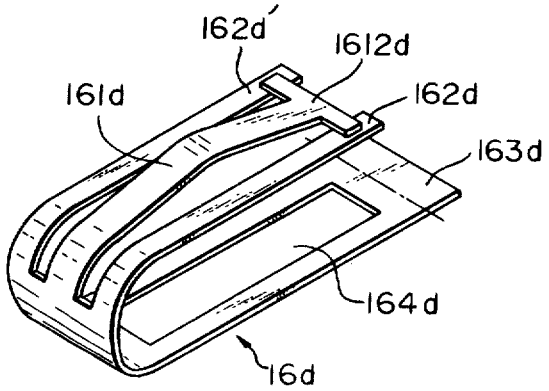
FIG. 11 is a perspective view of a spring member used in the embodiment of FIG. 10.

In another aspect of the present invention, as shown in FIGS. 10 and 11, the spring means is adapted to have a longer extending length between both ends to thereby provide a larger resiliency with respect to the direction in which the operating force F is applied. For this purpose, a substantially U-shaped spring means 16*d* of a bent plate material is formed to be longer in one leg than the other of the U-shape so that an end 163*d* of the longer leg will be a fixing end of the means to be fixed to a side wall of the housing 13 in the longitudinal direction of the micro-switch 11. The other relatively shorter leg is branched preferably at arcuate bent portion between the both legs into three so as to form a central spring leaf 161*d* provided at its free end with lateral extensions 1612*d* and a pair of lateral side spring leaves 162*d* and 162*d'* which are shorter than the central leaf 161*d*. In order to achieve the same relationship and functions of the respective biasing forces $F_1$ and $F_2$ at the respective free ends of these three leaves, in the present instance, the central leaf 161*d* is bent at its intermediate portion toward the longer leg having the base 163*d* and then the free ends of the both side leaves 162*d* and 162*d'* are urged to bow in the same direction in which the central leaf is bent and are engaged respectively to each of the lateral extensions 1612*d* on the side of the longer leg. An aperture 164*d* of a shape and size capable of freely receiving therein the micro-switch 11 is provided in the longer leg so that, in the assembled state as in FIG. 10, the longer leg extends across the entire length in the longitudinal direction of the micro-switch 11 while the other leg of the central and side spring leaves is bent back along a longitudinal side on which the push-button 12 of the micro-switch is disposed to extend substantially over the entire length of the micro-switch, so that the entire length of the spring means 16*d* can be made remarkably larger. In this position of the means, the side spring leaves 162*d* and 162*d'* are to engage the respective folked ends 1481 and 1482 of the operating means 14 at their portions adjacent the free ends engaging with the lateral extensions 1612*d* and the central spring leaf 161*d* is disposed to be engageable with the push-button 12, in the same manner as disclosed with reference to the first embodiment, so as to achieve the same operation.

In the present instance, on the other hand, the application of the operating force F onto the side spring leaves 162*d* and 162*d'* through the folked ends of the operating means 14 causes not only these side spring leaves but also the leg on the side of the fixing base to flex so that the side spring leaves can provide a greater stroke for the OT absorption. With the enlarged length of the spring means for the entire flexion thereof, further, any stresses normally imposed as concentrated to a portion adjacent a stationary or fixed end of any flexible member when the same is bent can be effectively dispersed substantially over the entire length of the U-shaped spring means 16*d* in the present instance, more remarkably than in the case of the L-shaped spring means.

In the case of the U-shaped spring means, further, the simultaneous flexion of the leg on the fixing side together with the bending of the side spring leaves 162*d* and 162*d'* responsive to the operating force F causes the arcuate bent portion of the U-shaped spring means to shift in the same direction of the force F, which will result in a shifting of the whole of the central spring leaf 161*d* toward the push-button 12. If the U-shaped spring means 16*d* is properly designed to achieve such shifting of the central leaf 161*d* to an extent enough for actuating the push-button, the central leaf may not be needed to have the lateral extensions for engaging with the side leaves nor to be preliminarily bent since the biasing force $F_1$ can be provided by the flexional shifting of the central leaf together with the flexion of the leg on the fixing side. However, the provision of the lateral extensions as well as that of the preliminary bending to the central leaf 161*d* will meet an optimum result in respect of the most reliable operation.

While the spring means employed in the present invention has been disclosed only with reference to those formed of the plate spring, it should be appreciated that a wire spring formed properly for achieving the relationship and functions of the biasing forces $F_1$ and $F_2$ may take place of the plate spring with the same results. It is also possible to replace either of the central or lateral side leaves with the wire spring.

The central and lateral side spring leaves have been also shown only as being joined on their fixing side to be an integral member, but they can be prepared separately from each other and assembled to be fixed to the housing wall or the like jointly at substantially the same position of achieving the disclosed relationship and functions of the biasing forces $F_1$ and $F_2$. Such separately prepared spring leaves may even be fixed to different and separate positions in the housing so long as the desired relationship and functions of the biasing forces $F_1$ and $F_2$ can be well achieved and, in this case, the side spring leaves providing the biasing force $F_2$ may, preferably, be formed in the L-shape. While the side spring leaves of the spring means have been disclosed as being two respectively extending along both lateral sides of the central spring leaf, further, these side spring leaves may even be single so as to extend along only one lateral side of the other leaf providing the force $F_1$ for actuating the switch mechanism, so long as such single side leaf is effective to provide the force $F_2$ achieving the desired relationship and function with respect to the force $F_1$.

The limit switch to which the present invention relates has been referred to specifically in the first embodiment as being of the type having the cantilevered arm resiliently biased to its outermost non-actuating position to be operable to actuate the switch through the operating member. It should be appreciated, however, that the limit switch may not be limited to the particular type but may be of such other type as, for example, having no cantilevered arm in which a reciprocally moving member of the associated device directly operates the slidably disposed operating member represented by the rigid members 146 and 148 in the first embodiment. In this case, the operating member should be formed preferably to project out of the housing to an extent enough for covering operating stroke of the moving member. While the operating member has been shown to be formed of the two rigid members 146 and 148, further, it is also possible to form these members to be integral.

According to the present invention, as has been disclosed in the foregoings, a first spring means referred to in the form of the central spring leaf which provides to the push-button of switch mechanism the first biasing force $F_1$ acting substantially in the same direction as the operating force F and a second spring means referred to in the form of the side spring leaf or leaves which provides to the operating member and first spring means the second biasing force $F_2$ are disposed in the interior space of the housing of the limit switch as fixed as their one end to have the other free end of them extended substantially along the housing wall or the body of switch mechanism to the position of achieving the respective biasing forces, so that the first and second spring means will be positioned in their non-actuating state in which the first and second biasing forces are mutually balanced requiring the least space, the application of the operating force F to the operating member will cause the second spring means to bow to allow the first spring means to actuate the push-button with the first biasing force $F_1$, any OT stroke of the operating member will be absorbed by the second spring means which is capable of bowing freely irrespective of the push-button and body of the switch mechanism, and upon release of the operating force F the second spring means returns to the original state and urges the first spring means to be separated from the push-button with the second biasing force $F_2$. Therefore, there are brought about such effects that the required space for the PT stroke of the operating means for the switch actuation can be made the minimum so as to allow the means including the spring means contained substantially within the housing of the limit switch and thereby the size of the limit switch can be effectively minimized, that the stroke of the operating means responsive to the operating force can selectively set irrespective of the stroke required for operating the push-button, that the required space for the OT absorption can be made remarkably larger since the second spring means performs such absorption irrespective of the stroke of the operating means and of other elements in the switch, that the required operating force can be made smaller since the operating means is required to only break the mutual balanced relationship of the first and second spring means so that the first spring means will actuate the switch with its own biasing force, and that required number of parts can be made smaller as the second spring means requires no separate elements for defining the respective PT and OT strokes of the means so that the assembling works can be simplified and the manufacturing costs can be lowered.

What we claim as our invention:

1. In a limit switch comprising a switching means having a push-button for actuating said means, a housing having an interior space for housing said switching means, means provided to communicate said interior space with the exterior of said housing for operating said push-button to actuate the switching means by transmitting an externally given operating force to the push-button, means cooperating with said operating means for absorbing said operating force applied sequentially after an actuation of the switching means, the combination comprising a first spring means fixed at one end within said interior space of the housing and extended at the other end to be engageable with the push-button, said the other end of said first spring means providing a first biasing force acting substantially in the same direction as said operating force, and a second spring means fixed at one end within said interior space of the housing and extended at the other end to a position adjacent said the other end of said first spring means to provide thereto a second biasing force in a direction opposite to the operating force for normally restraining the other end of the first spring means from engaging the push-button against said first biasing force, said second spring means engaging said operating means to act as said absorbing means and releasing said restraint to the other end of the first spring means in response to the operating force applied through the operating means to allow the first spring means to engage and operate the push-button with the first biasing force.

2. A limit switch according to claim 1 wherein said the other end of said second spring means engages said the other end of said first spring means to normally balance said first biasing force with said second biasing force.

3. A limit switch according to claim 2 wherein said first spring means is provided at said the other end with a part extended at least in one lateral side direction, and said second spring means engages at said the other end with said extended part of the first spring means.

4. A limit switch according to claim 2 wherein said first spring means is provided at said the other end with parts extended in both lateral side directions, and said second spring means engages at said the other end with respective said extended parts of the first spring means.

5. A limit switch according to claim 4 wherein said second spring means is branched at least at said the other end into two parts and engages at respective said two branched parts with each of said laterally extended parts of said first spring means.

6. A limit switch according to claim 5 wherein said lateral extensions of said first spring means comprises a rigid and separate member secured to said other end of the first spring means.

7. A limit switch according to claim 1 wherein said first and second spring means are formed integral respectively at their portion from said one end fixed to an intermediate position between the one end and said the other end.

8. A limit switch according to claim 1 wherein said first and second spring means are formed integral at least at their said one ends to form a base to be fixed, and respective said the other ends extend from said base substantially in parallel to each other.

9. A limit switch according to claim 8 wherein said first spring means is provided at said the other end with parts extended in both lateral side directions, and said the other end of said second spring means is branched into two from said integral base and engages at said branched other two ends with respective said both laterally extended parts of the first spring means.

10. A limit switch according to claim 9 wherein said first and second spring means are formed of an integral spring plate of an elongated shape.

11. A limit switch according to claim 9 wherein said first and second spring means are formed of an integral spring plate of an elongated shape, said spring plate being cut into three branches extending from said base, and one in the center of said three branches being the first spring means having said laterally extended parts.

12. A limit switch according to claim 9 wherein said first and second spring means are formed of an integral spring plate of an elongated shape, said spring plate being cut into three branches extending from said base, and one in the center of said three branches being the first spring means which is cut substantially into a T-shape.

13. A limit switch according to claim 12 wherein others of said three branches on both sides of said central first spring means are forming said second spring means which are slightly longer than the central first spring means and preliminarily bent at an intermediate portion of the branches to provide said second biasing force.

14. A limit switch according to claim 12 wherein said integral spring plate is bent at a portion adjacent said base substantially into an L-shape.

15. A limit switch according to claim 12 wherein said integral spring plate is bent at an intermediate portion between said base and said extended other ends substantially into a U-shape.

16. A limit switch according to claim 15 wherein said three branches are formed from said intermediate bent portion to respective said the other ends of said first and second spring means, and said U-shaped spring plate is provided at a portion between said base and said bent portion with an aperture allowing a body of said switch means to be freely disposed therein.

17. A limit switch according to claim 12 wherein said T-shaped first spring means is slightly longer than the others on both sides of the first spring means and is preliminarily bent at an intermediate portion of the branch to provide said first biasing force.

18. A limit switch according to claim 12 wherein said operating means is provided with two folked ends for engaging other two of said three branches on both sides of said central first spring means, said two branches forming said second spring means.

19. A limit switch according to claim 1 wherein said first and second spring means are prepared separately from each other.

20. A limit switch according to claim 19 wherein said first and second spring means are fixed at their said one end substantially at the same position in said housing.

* * * * *